US005231825A

United States Patent [19]

Baughman et al.

[11] Patent Number: 5,231,825

[45] Date of Patent: Aug. 3, 1993

[54] METHOD FOR COMPRESSOR AIR EXTRACTION

[75] Inventors: John L. Baughman; Rollin G. Giffin, III, both of Cincinnati, Ohio

[73] Assignee: General Electric Company, Cincinnati, Ohio

[21] Appl. No.: 799,236

[22] Filed: Nov. 27, 1991

Related U.S. Application Data

[62] Division of Ser. No. 506,314, Apr. 9, 1990, Pat. No. 5,155,993.

[51] Int. Cl.[5] ..... F02C 6/18; F02G 3/00

[52] U.S. Cl. ..... 60/204; 60/39.07

[58] Field of Search ..... 60/204, 39.07

[56] References Cited

U.S. PATENT DOCUMENTS

| | | | |
|---|---|---|---|
| 2,823,516 | 2/1958 | Schelp | 60/39.07 |
| 2,873,756 | 2/1959 | Pool | 137/87 |
| 3,092,128 | 6/1963 | Pembleton | 137/81.1 |
| 3,108,767 | 10/1963 | Eltis et al. | 60/39.07 |
| 3,625,630 | 12/1971 | Soo | 415/207 |
| 3,688,504 | 9/1972 | Hutchinson et al. | 60/226.1 |
| 3,765,792 | 10/1973 | Exley | 415/181 |
| 3,778,186 | 12/1973 | Bandukwalla | 415/481 |
| 3,841,091 | 10/1974 | Sargisson et al. | 60/224 |
| 3,879,941 | 4/1975 | Sargisson | 60/226 |
| 3,898,799 | 8/1975 | Pollert et al. | 60/39.07 |
| 3,909,152 | 9/1975 | Rannenberg | 415/27 |
| 4,010,608 | 3/1977 | Simmons | 60/226 |
| 4,054,030 | 10/1977 | Pedersen | 60/262 |
| 4,055,946 | 11/1977 | Sens | 60/204 |
| 4,068,471 | 1/1978 | Simmons | 60/262 |
| 4,069,661 | 1/1978 | Rundell et al. | 60/204 |
| 4,072,008 | 2/1978 | Kenworthy et al. | 60/261 |
| 4,080,785 | 3/1978 | Koff et al. | 60/226 |
| 4,175,384 | 11/1979 | Wagenknecht et al. | 60/226 |
| 4,214,610 | 7/1980 | James et al. | 137/597 |
| 4,222,233 | 9/1980 | Johnson et al. | 60/225 |
| 4,349,314 | 9/1982 | Erwin | 415/181 |
| 4,409,788 | 10/1983 | Nash et al. | 60/226.3 |
| 4,445,816 | 5/1984 | Ribaud et al. | 415/181 |
| 4,546,605 | 10/1985 | Mortimer et al. | 60/39.07 |
| 4,592,200 | 6/1986 | Benoist et al. | 60/261 |
| 4,715,779 | 12/1987 | Suciu | 60/39.07 |
| 4,791,783 | 12/1988 | Neitzel | 60/262 |
| 4,813,229 | 3/1989 | Simmons | 60/204 |
| 4,827,713 | 5/1989 | Peterson et al. | 60/226.1 |
| 4,901,520 | 2/1990 | Kozak et al. | 60/39.07 |
| 4,961,312 | 10/1990 | Simmons | 60/204 |
| 4,969,326 | 11/1990 | Blessing et al. | 60/226.1 |

FOREIGN PATENT DOCUMENTS

| | | |
|---|---|---|
| 0296058 | 6/1988 | European Pat. Off. . |
| 1626114 | 10/1973 | Fed. Rep. of Germany . |
| 1109212 | 1/1956 | France . |
| 2270450 | 12/1975 | France . |
| 0262065 | 6/1949 | Switzerland . |
| 0586573 | 3/1947 | United Kingdom . |
| 0700098 | 11/1953 | United Kingdom . |
| 0980306 | 1/1965 | United Kingdom . |
| 1324790 | 7/1973 | United Kingdom . |
| 1523875 | 9/1978 | United Kingdom . |
| 219229 | 1/1988 | United Kingdom . |

OTHER PUBLICATIONS

Gasdynamik, by Ernst Becker, pp. 71–79, May 1966.

Shepard–"Principles of Turbomachinery"–DeLaval nozzles including choked and supersonic flow and shock (1956, pp. 100–125).

*Primary Examiner*—Richard A. Bertsch

*Assistant Examiner*—Howard R. Richman

*Attorney, Agent, or Firm*—Jerome C. Squillaro; David L. Narciso

[57] ABSTRACT

A method of obtaining extraction airflow from a compressor includes accelerating the extraction airflow to at least Mach 1 for obtaining choked airflow and decelerating the choked airflow to a speed less than Mach 1. An apparatus for carrying out the method includes a compressor casing having an extraction airflow port, first means for accelerating the extraction airflow channeled through the port to at least Mach 1 for obtaining choked airflow, and means for decelerating the choked airflow to a speed less than Mach 1. In an exemplary embodiment, a converging-diverging nozzle is provided for accelerating the extraction airflow to at least Mach 1 and then decelerating the choked airflow.

3 Claims, 5 Drawing Sheets

FLOW FUNCTION
+
F1
0
HIGH SPEED
LOW SPEED
1
PRℓ
1.2
1.4
PRh
1.6
1.8
2
PRESSURE RATIO

OPEN
75% OPEN
50% OPEN
FLOW FUNCTION
+
F1
0
LOW SPEED
HIGH SPEED
1
1.2
1.4
1.6
1.8
2
PRESSURE RATIO

Fig. 5.
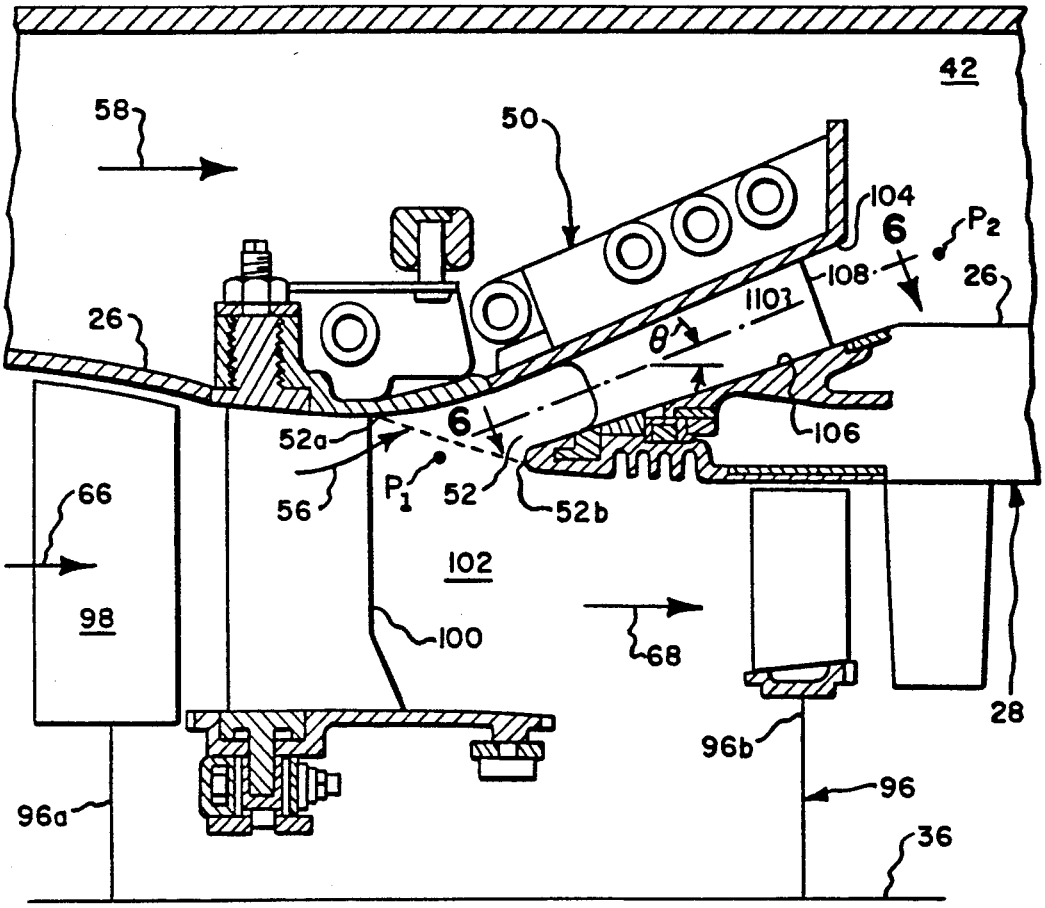
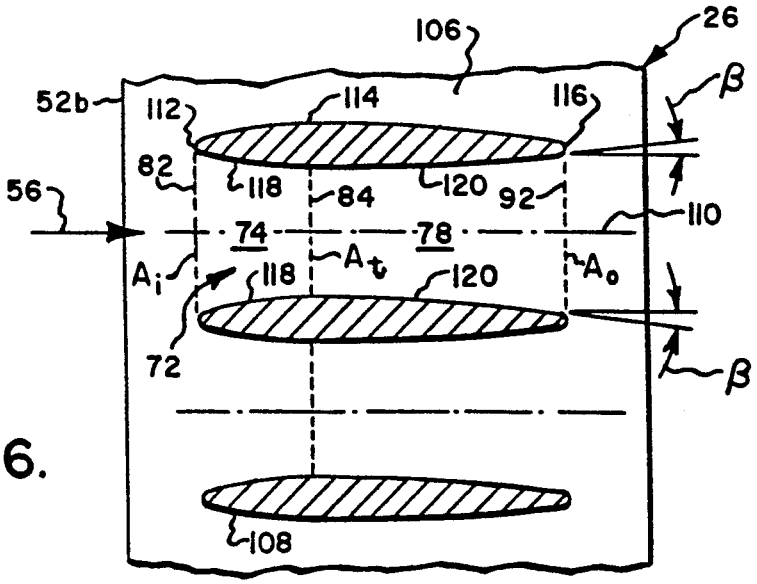
Fig. 6.

Fig. 7.
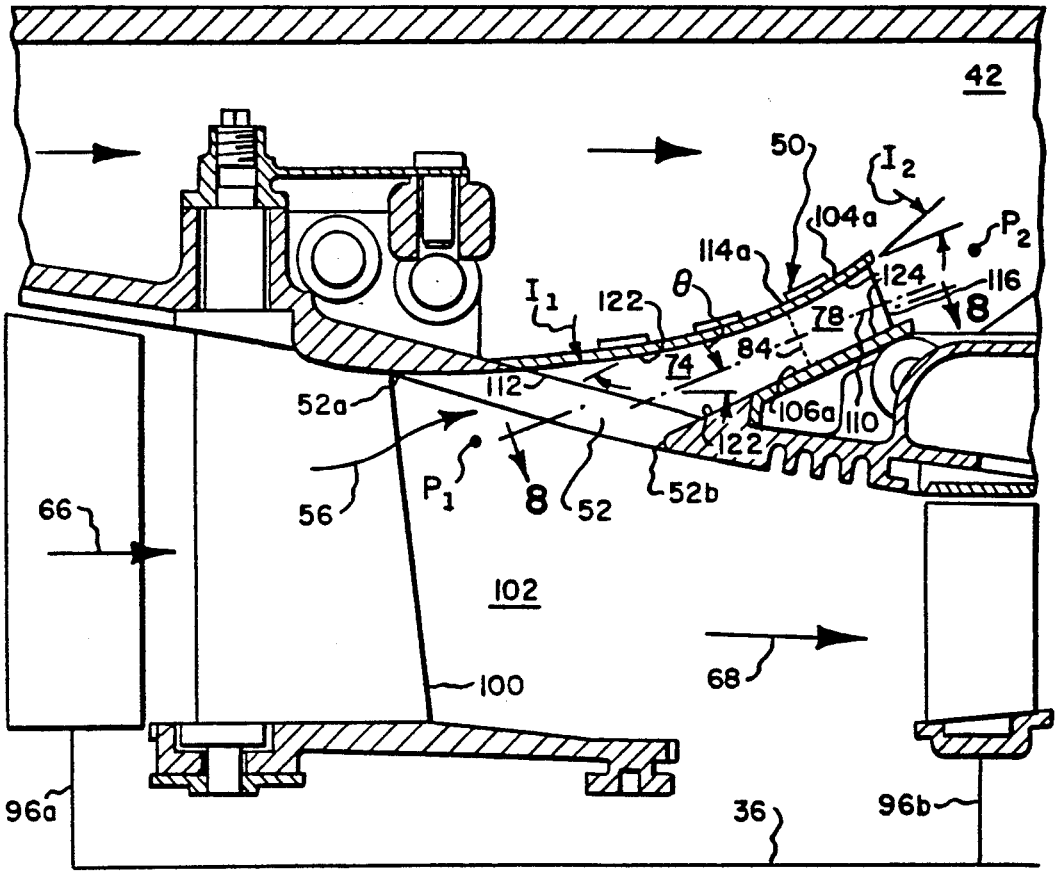
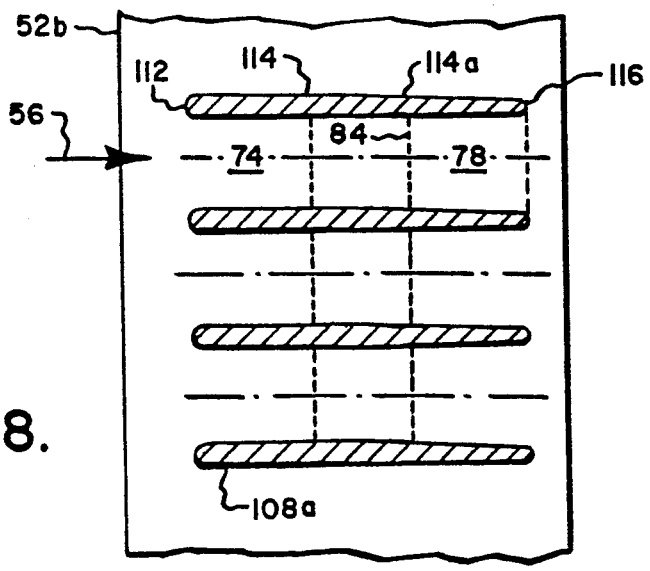
Fig. 8.

Fig. 7a
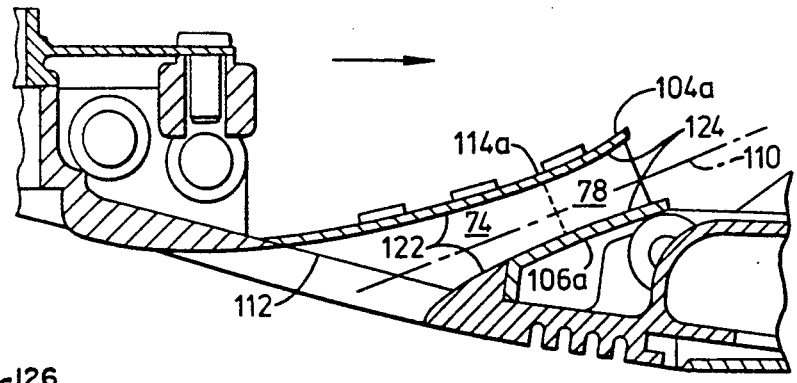
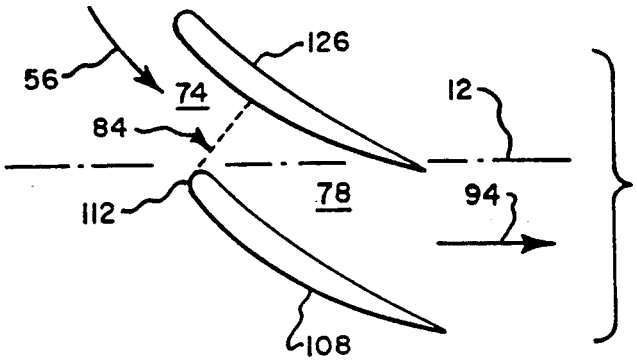
Fig. 9.
Fig. 11.
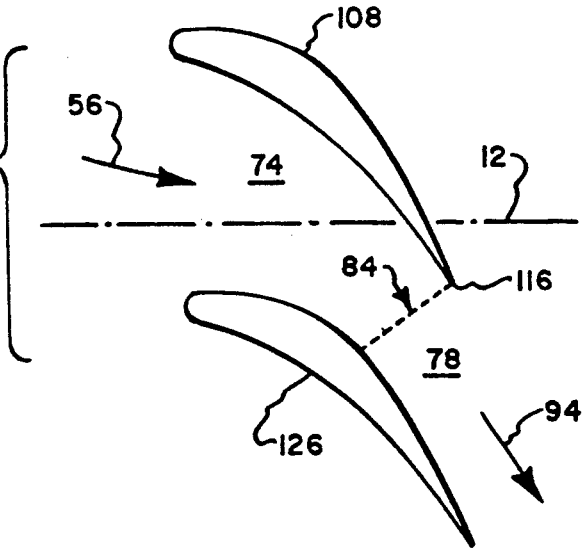
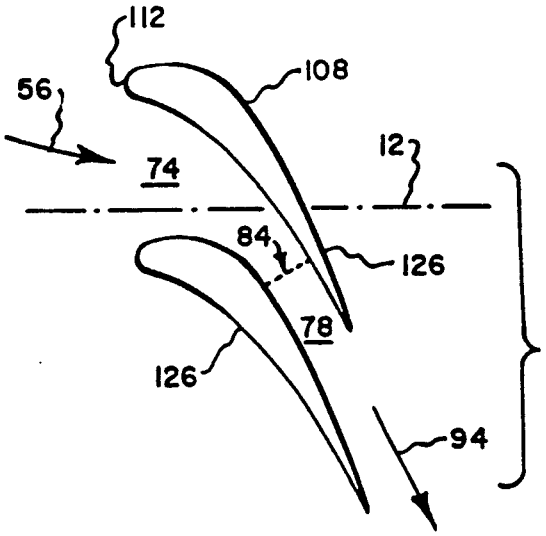
Fig. 10.

METHOD FOR COMPRESSOR AIR EXTRACTION

The Government has rights in this invention pursuant to Contract No. F33657-83-C-0281 awarded by the Department of Air Force.

This application is a division of U.S. application Ser. No. 07/506,314, filed Apr. 9, 1990 now U.S. Pat. No. 5,155,993.

TECHNICAL FIELD

The present invention relates generally to variable cycle, bypass, turbofan gas turbine engines, and, more specifically to a method and apparatus for extracting a portion of compressor air as bleed air or bypass air.

BACKGROUND ART

In a conventional gas turbine engine, such as a bypass turbofan engine, bypass or bleed air is extracted between stages of a multi-stage axial compressor for various purposes. For example, in a bypass engine, compressed air is extracted as bypass airflow which bypasses the core engine as is conventionally known. In an engine operated so that pressure in the bypass duct is relatively equal to pressure inside the compressor where the compressed air is being extracted, the relative mass flow of the air extracted increases as the compressor speed is reduced unless means for modulating the extraction airflow are utilized. In some engine applications, this increase in extraction airflow at lower speeds is undesirable, and, therefore, a conventional mechanical valve is typically utilized. The valve is positionable for throttling the extraction airflow so that as compressor speed decreases, the valve may be closed for preventing a corresponding increase in extraction airflow. The mechanical valve arrangement necessarily adds weight, complexity, and cost to the compressor system and requires a control system for varying the valve settings.

OBJECTS OF THE INVENTION

Accordingly, it is one object of the present invention to provide a new and improved method and apparatus for extracting airflow from a gas turbine engine compressor.

Another object of the present invention is to provide a new and improved compressor extraction assembly which automatically throttles extraction airflow from the compressor.

Another object of the present invention is to provide a compressor extraction assembly for throttling airflow without mechanically varying extraction flow area.

Another object of the present invention is to provide a compressor extraction assembly effective for obtaining a relatively constant extraction airflow over a selected speed range of the compressor.

Another object of the present invention is to provide a compressor extraction assembly effective for maintaining relatively constant extraction airflow at relatively low bypass pressure ratios less than about 1.5.

DISCLOSURE OF INVENTION

A method of obtaining extraction airflow from a compressor includes accelerating the extraction airflow to at least Mach 1 for obtaining choked airflow and decelerating the choked airflow to a speed less than Mach 1. An apparatus for carrying out the method includes a compressor casing having an extraction airflow port, first means for accelerating the extraction airflow channeled through the port to at least Mach 1 for obtaining choked airflow, and means for decelerating the choked airflow to a speed less than Mach 1. In an exemplary embodiment, a converging-diverging nozzle is provided for accelerating the extraction airflow to at least Mach 1 and then decelerating the accelerated airflow.

BRIEF DESCRIPTION OF DRAWINGS

The novel features believed characteristic of the invention are set forth and differentiated in the claims. The invention, in accordance with preferred and exemplary embodiments, together with further objects and advantages thereof, is more particularly described in the following detailed description taken in conjunction with the accompanying drawing in which:

FIG. 5 is a partly schematic, transverse sectional view of one embodiment of the compressor extraction assembly including a plurality of struts circumferentially spaced apart to define converging-diverging nozzles.

FIG. 6 is a sectional view of the struts illustrated in FIG. 5 taken along line 6—6.

FIG. 7 is a partly schematic, transverse sectional view of another embodiment of a compressor extraction assembly having a plurality of circumferentially spaced struts extending between converging-diverging flowpath surfaces.

FIG. 8 is a sectional view of the struts illustrated in FIG. 7 taken along line 8—8.

FIG. 9 is a sectional view of another embodiment of two adjacent struts positioned for obtaining a converging-diverging nozzle with a throat defined at a leading edge.

FIG. 10 is a sectional view of another embodiment of two adjacent struts positioned for defining a converging-diverging nozzle having a throat disposed between trailing and leading edges thereof.

FIG. 11 is a sectional view of another embodiment of two adjacent struts positioned for obtaining a converging-diverging nozzle having a throat at a trailing edge thereof.

MODE(S) FOR CARRYING OUT THE INVENTION

Figure 1:
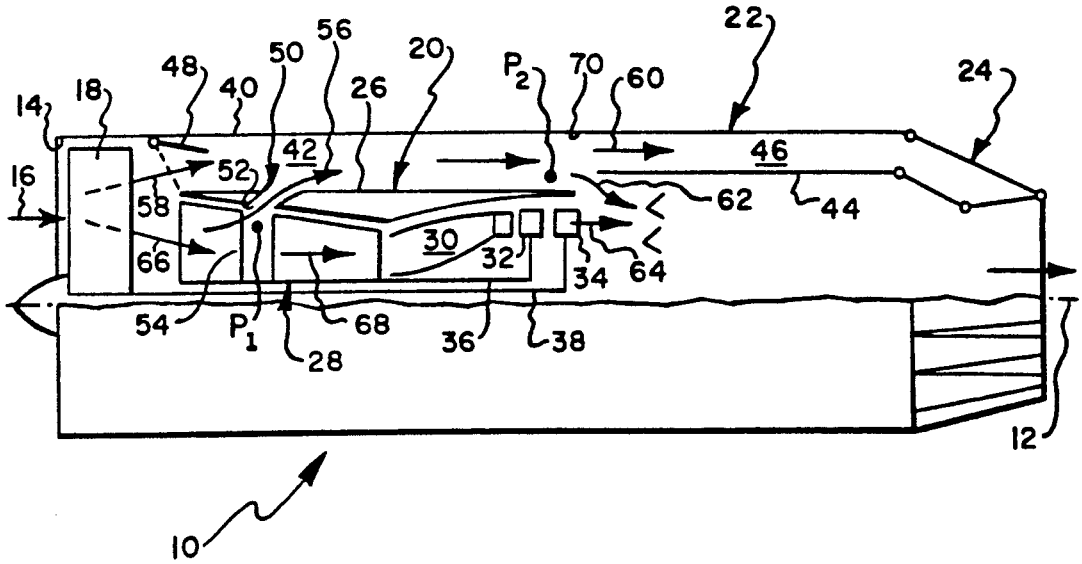
FIG. 1 is a schematic representation of a variable cycle, double bypass, turbofan gas turbine engine including a compressor extraction assembly in accordance with one embodiment of the present invention.

Illustrated in FIG. 1 is an exemplary, variable cycle, double bypass, turbofan gas turbine engine 10 for powering an aircraft. The engine 10 includes a longitudinal centerline axis 12 and a conventional annular inlet 14 for receiving ambient air 16. A conventional fan 18 is disposed in the inlet 14 which is in turn disposed in flow communication with a conventional core engine 20, augmentor, or afterburner, 22, and variable area exhaust nozzle 24.

The core engine 20 includes an annualar casing 26 which surrounds a high pressure compressor (HPC) 28, combustor 30, high pressure turbine (HPT) 32, and low pressure turbine (LPT) 34. The HPT 32 drives the HPC 28 through a conventional first rotor shaft 36. The LPT 34 drives the fan 18 through a conventional second rotor shaft 38. Spaced radially outwardly from and surrounding the core engine 20 is a conventional outer casing 40 which defines a conventional bypass duct 42 therebetween. The augmentor 22 includes an augmentor liner 44 spaced radially inwardly from the outer casing 40 to define an augmentor bypass channel 46 disposed in flow communication with the bypass duct 42. Disposed at an inlet of the bypass duct 42 is a conventional mode selector valve 48 which is selectively positionable between an open position shown in solid line and a closed position shown in dashed line.

Disposed at an intermediate stage of the HPC 28 is a compressor extraction assembly 50 in accordance with one embodiment of the present invention. The assembly 50 includes the compressor casing 26 having an annular port 52 disposed circumferentially around the centerline axis 12 for joining in flow communication a preselected stage 54 of the HPC 28 to the bypass duct 42.

The engine 10 is considered a double bypass engine since the inlet airflow 16 is channeled through the HPC 28 and an extraction airflow portion 56 is channeled through the port 52 into the bypass duct 42. The extraction airflow 56, in this embodiment of the invention, is a first bypass airflow 56 which bypasses the remainder of the core engine and is channeled to the augmentor 22. Another portion of the inlet airflow 16 is channeled as a second bypass airflow 58 i.e., double bypass, into the bypass ducts 42 upstream of the HPC 28 through the mode selector valve 48 when it is disposed in its open position. The second bypass airflow 58 joins with the first bypass airflow 56 and is channeled to the augmentor 22 where a first portion 60 thereof is channeled in the augmentor bypass channel 46 for cooling the liner 44 and the nozzle 24. A second portion 62 is channeled radially inwardly of the augmentor liner 44 for mixing with core engine discharge gases 64.

The inlet airflow 16 enters the core engine 20 as a first core airflow 66, a portion of which is extracted as the extraction airflow 56 with the remainder being a second core airflow 68 which is channeled to the combustor 30 for being mixed with fuel and ignited for generating the combustion gases 64.

The engine 10 is also operable in a single bypass mode wherein the mode selector valve 48 is closed for preventing the second bypass airflow 58 from entering the bypass duct 42 but instead being channeled into the core engine 20 in the first core airflow 66.

Except for the compressor extraction assembly 50 in accordance with the invention, the remainder of the engine 10 and core engine 20 is conventional. The core engine 20 and the bypass duct 42 are conventionally sized for obtaining a conventional pressure ratio inside the HPC 28 adjacent to the port 52 and relative to an outlet 70 of the bypass duct 42. The bypass air second portion 62 is channeled from the outlet 70 into the augmentor radially inwardly of the liner 44. The pressure ratio may be represented by $P_1/P_2$ where $P_1$ is a total pressure upstream of the port 52 and $P_2$ is a static pressure downstream of the compressor extraction assembly 50.

In this exemplary embodiment of the invention, the pressure ratio $P_1/P_2$ is relatively small and has values greater than 1 and up to about 1.5 in the operation of the engine 10. With such a relatively small pressure ratio (PR) $P_1/P_2$, the pressure $P_1$ inside the HPC 28 is relatively close in value to the pressure inside the bypass duct 42. In the engine 10, it is desirable to maintain a relatively constant bypass ratio of the first bypass airflow 56 over a range of speeds of the HPC 28. More specifically, the bypass ratio is conventional and may be defined as the quantity of the first bypass airflow 56 divided by the quantity of the second core airflow 68. The quantity of the first bypass airflow 56 may be represented by a Flow Function defined as:

$$\text{Flow Function} = m\sqrt{T}/(AP_1)$$

wherein m represents mass flow rate, T represents total temperature associated with the upstream pressure $P_1$, and A represents the minimum flow area of the port 52.

Figure 2:
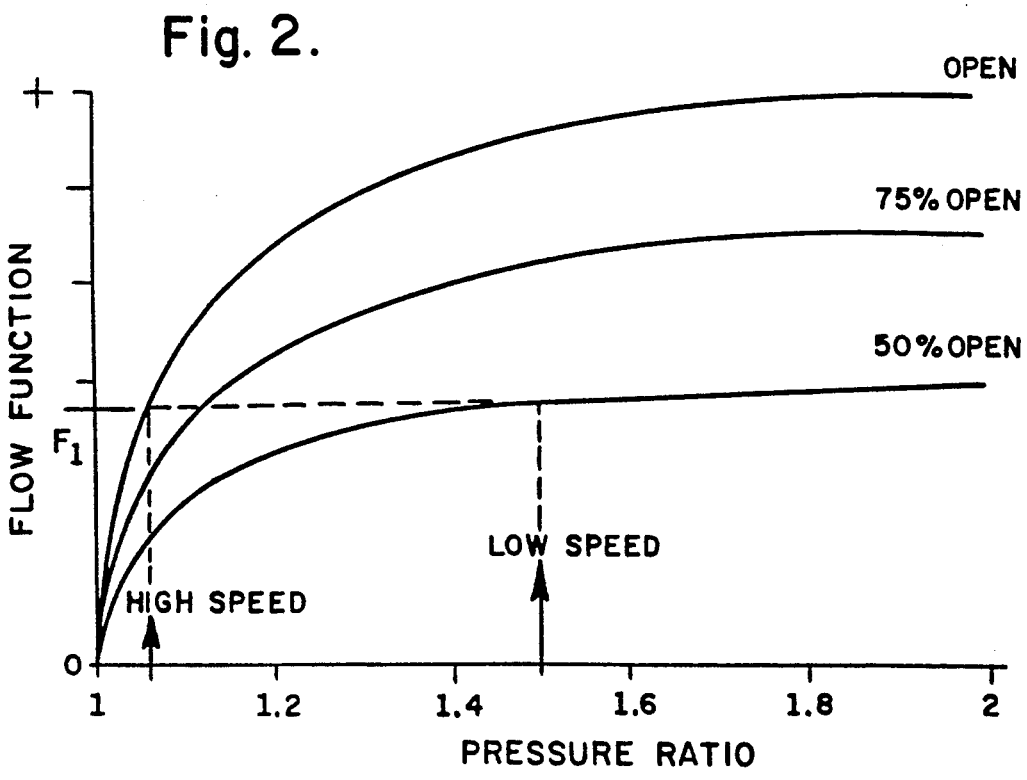
FIG. 2 is a graph plotting flow function versus pressure ratio for a conventional mechanically throttled compressor extraction port.

Illustrated in FIG. 2 is an analytically generated graph plotting the Flow Function versus the pressure ratio ($P_1/P_2$) for the engine 10 assuming that the port 52 is conventional and includes a conventional mechanical valve effective for controlling the flow area A thereof. The HPC 28 is operable in a speed range including a high speed, for example, the maximum rotational speed of the first shaft down to relatively low speeds, such as those associated with cruise or idle for example. The port 52 is conventionally sized so that when it is fully open with a maximum flow area A, a predetermined Flow Function $F_1$ is obtained at the relatively low pressure ratio 1.05, for example. However, as the rotational speed N of $F_1$ first shaft 36 decreases in operation of the engine 10, and the pressure ratio increases, the Flow Function increases which is undesirable, for example, for maintaining a relatively constant bypass ratio.

Accordingly, in order to prevent the increase of the Flow Function, a conventional engine will include the conventional throttling valve which decreases the flow area A of the port 52 as the first shaft speed N is decreased in order to maintain a generally constant value of the Flow Function at the value $F_1$. As the graph in FIG. 2 illustrates, for the speed range of the engine from high to low speed, the conventional valve is continuously throttled from an open to about 50% open position for maintaining a generally constant value $F_1$ of the Flow Function.

In accordance with one object of the present invention, the compressor extraction assembly 50 is effective for obtaining a substantially constant value of the Flow Function over the speed range and relatively low pressure ratio range without the use of a mechanical throttling valve.

Figure 3:
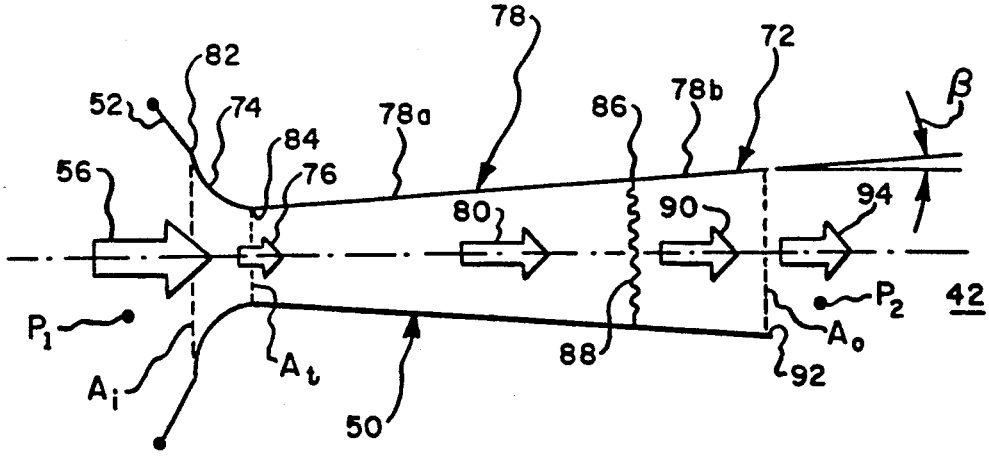
FIG. 3 is a schematic representation of one embodiment of the compressor extraction assembly in the form of a converging-diverging nozzle.

More specifically, FIG. 3 illustrates schematically a converging-diverging (CD) nozzle 72 disposed in flow communication with the port 52 which is effective for obtaining a substantially uniform Flow Function over the high to low speed range of the first shaft 36 of the HPC 28 at relatively low pressure ratios ranging from about 1.05 to about 1.5, for example. The compression extraction assembly 50 includes first means 74 for accelerating the extraction airflow 56 channeled through the port 52 for obtaining choked airflow 76 of the extraction airflow 56. Second means 78 for accelerating the choked airflow 76 to a speed greater than Mach 1 for obtaining supersonic airflow 80 is disposed in flow communication with the first means 74. The first accelerating means 74 is preferably in the form of a conventional converging nozzle 74 having an inlet 82 for receiving the extraction airflow 56 from the port 52. The nozzle 74 also includes a throat 84 of minimum flow area $A_t$, with the inlet having a larger flow area $A_i$. The second accelerating means 78 is in the form of a conventional diverging nozzle 78 having an upstream portion 78*a* extending from the throat 84 to an intermediate section 86. The intermediate section 86 is defined as that point in the diverging nozzle 78 at which the supersonic airflow 80 decreases in speed to below Mach 1 which may occur at a conventional shock wave 88.

Accordingly, means for decelerating the supersonic airflow 80 to a speed less than Mach 1 for creating airflow 90 is preferably in the form of a downstream portion 78*b* of the diverging nozzle 78 which extends from the intermediate section 86 to an outlet 92 having a flow area $A_o$. The outlet 92 is effective as means for discharging the subsonic airflow 90 as discharged airflow 94 into the bypass duct 42.

The CD nozzle 72 is effective for practicing a method of extracting the extraction airflow 56 from the port 52 in the HPC 28 which includes the steps of accelerating the extraction airflow 56 in the converging nozzle 74 to Mach 1 for obtaining the choked airflow 76, and then decelerating the choked airflow 76 to a speed less than Mach 1 as subsonic airflow 90. The method also includes discharging the subsonic airflow 90 through the outlet 92 into the bypass duct 42 as the discharged airflow 94. More specifically, the method further includes the step of accelerating the choked airflow 76 to a speed greater than Mach 1 in the diverging nozzle 78 for obtaining the supersonic airflow 80 before decelerating the airflow 80 to the subsonic airflow 90.

Figure 4:
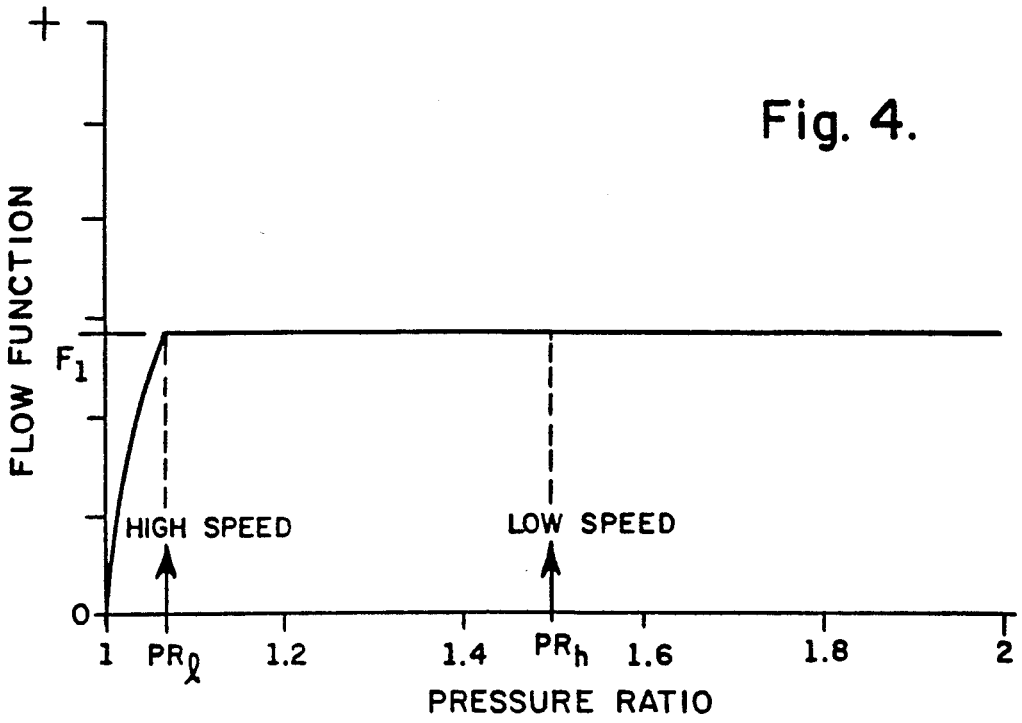
FIG. 4 is a graph plotting a flow function versus a pressure ratio across the compressor extraction assembly in accordance with a preferred embodiment.

By generating the choked airflow 76 at the throat 84, the Flow Function will not exceed the predetermined value $F_1$ as illustrated in the analytically generated graph in FIG. 4. The CD nozzle 72 is conventionally sized and configured for obtaining choked airflow in the throat 84 at the predetermined high speed, i.e. maximum speed, at a corresponding relatively low pressure ratio $PR_l$. As the first shaft 36 decreases in speed to the relatively low speed, for example, at cruise, the pressure ratio increases in the engine 10 which maintains the choked airflow 76 at the throat 84 in the nozzle 72 for maintaining a relatively constant preselected value $F_1$ of the Flow Function. The pressure ratio associated with the low speed is designated $PR_h$ which is greater than the pressure ratio $PR_1$ associated with the high speed operation. In the exemplary embodiment illustrated in the graph in FIG. 4, and for ideal flow, $PR_l$ is about 1.05 and $PR_h$ is about 1.5.

Accordingly, the engine 10 is sized and configured for generating the pressure ratio $P_1/P_2$ of up to about 1.5 as the extraction airflow 56 is accelerated and decelerated for obtaining choked and subsonic airflow. In the exemplary embodiment, the supersonic airflow 80 occurs over the entire speed range from the low speed to the high speed, including the maximum speed of the first shaft 36.

The CD nozzle 72 illustrated in FIG. 3 is conventionally designed based on the desired operating pressure ratio $P_1/P_2$, such as for example over the range $PR_h$ to $PR_l$. The area ratios $A_oA_t$ /and $A_i/A_t$ are similarly conventionally determined for obtaining the nozzle 72 effective for obtaining the choked airflow 76 and the supersonic airflow 80. In the preferred embodiment, the area ratio $A_o/A_t$ is about 2, and the area ratio $A_i/A_t$ is about 1.07, which is effective for providing a constant Flow Function value $F_1$ over the speed range of high to low and over the pressure ratios $P_1/P_2$ ranging between 1.05 to about 1.5 as illustrated in FIG. 4. The diverging nozzle 78 conventionally has straight sides diverging at a half angle $\beta$ which is conventionally up to about 12° for providing an effective supersonic diffuser at the desired pressure ratios $P_1/P_2$. At such pressure ratios, for example up to about 1.5, the conventional shock 88 will occur in the diverging nozzle 78 and will create the subsonic airflow 90. In other embodiments of the invention, the intermediate section 86 may be coincident with the outlet 92.

The pressure ratios associated with the speed range of operation of the CD nozzle 72 as illustrated in FIG. 4, are relatively low as compared to pressure ratios greater than about 1.85 for obtaining supersonic velocities of combustion gasses channeled through conventional variable area (CD) exhaust nozzles. However, conventional supersonic design practices nevertheless apply to design the CD nozzle 72 for particular applications in accordance with the present invention.

The compressor extraction assembly illustrated in FIG. 3 is a schematic representation that may be effected in accordance with various embodiments of the invention. For example, illustrated in FIG. 5 is one embodiment of the compressor extraction assembly 50 for providing the extraction airflow in the form of the first bypass airflow 56 illustrated in FIG. 1.

More specifically, the HPC 28 is in the form of an axial compressor having a plurality of axially spaced rotor stages 96 fixedly connected to the first shaft 36. The compressor casing 26 in this exemplary embodiment, surrounds a first row, or stage, 96*a* of a plurality of circumferentially spaced compressor blades 98 which extend radially outwardly from the first shaft 36. Disposed immediately downstream of the first stage 96*a* is a plurality of conventional variable outlet guide vanes (OGVs) 100. The OGVs 100 are spaced upstream from a second stage 96*b* of the HPC 28. Further compressor stages 96 are disposed upstream of the first row 96*a* and downstream of the second stage 96*b* in this exemplary embodiment. The compressor casing 26 defines a flow channel 102 between the first and second stages 96*a* and 96*b* for receiving the first core airflow 66 compressed by the first stage 96*a*.

The casing port 52, in this exemplary embodiment, is annular about the engine longitudinal centerline 12 and includes an annular upstream edge 52*a* and an annular downstream edge 52*b* spaced from the upstream edge 52*a*. Extending downstream from the port upstream edge 52*a* is an annular first flowpath surface 104, and extending downstream from the port downstream edge 52*b* is an annular second flowpath surface 106 spaced from the first flowpath surface 104. A plurality of circumferentially spaced struts 108 extend from the first flowpath surface 104 to the second flowpath surface 106 and are conventionally secured thereto. Referring to both FIGS. 5 and 6, defined between adjacent ones of the struts 108 is the CD nozzle 72 in flow communication with the port 52. The CD nozzle 72 has a longitudinal centerline CD axis 110 which is inclined radially outwardly in a downstream direction from the port 52 at an acute angle $\theta$ relative to the engine centerline axis 12 of about 20° for this exemplary embodiment.

As illustrated in FIG. 6, each of the struts 108 includes a leading edge 112 and intermediate section 114 of maximum thickness, and a trailing edge 116. Adjacent ones of the leading edges 112 defined therebetween the converging nozzle inlet 82, adjacent ones of the intermediate sections 114 defined therebetween the throat 84, and adjacent ones of the trailing edges define therebetween the diverging nozzle outlet 92. Each of the struts 108 further includes an arcuate upstream side surface 118 extending from the leading edge 112 to the intermediate section 114 with adjacent strut upstream side surfaces 118 defining therebetween the converging nozzle 74.

Each of the struts 108 also includes a generally flat downstream side surface 120 extending from the intermediate section 114 to the trailing edge 116 with adjacent strut downstream side surfaces 120 defining therebetween the diverging nozzle 78. The downstream side surfaces 120 are inclined relative to the CD axis 110 at the half-angle $\beta$ at an angle up to about 12° for obtaining supersonic diffusion of the extraction airflow 56 channeled through the CD nozzle 72.

In this embodiment of the invention, the first and second flowpath surfaces 104 and 106 have straight transverse sections and are generally parallel to each other and parallel to the CD axis 110 and therefore, the CD nozzle 72 is formed primarily by varying the area between adjacent struts 108 as described above. The flow areas $A_i$, $A_t$, and $A_o$ have the preferred ratios as described above, for example, with the area ratio $A_o/A_t$ being at least about 2, and the area ratio $A_i/A_t$ being about 1.07.

The compressor extraction assembly 50 illustrate in FIGS. 5 and 6 is effective for obtaining a Flow Function such as that illustrated in FIG. 4 over a pressure ratio $P_1/P_2$ up to about 1.5, for example. The pressure $P_1$ is defined at about the port 52 in the flow channel 102, and the pressure $P_2$ is defined in the bypass-duct 42 at about the outlet 92 of the CD nozzle 72. The port 52 preferably has a generally constant flow area until it reaches the converging nozzle inlet 112, although other embodiments of the port 52 may be utilized for providing the extraction airflow 56 to the CD nozzle 72 for operation in accordance with the invention.

Illustrated in FIGS. 7 and 8 is another embodiment of the compressor extraction assembly 50 which is similar to the embodiment illustrated in FIG. 5 except that the CD nozzles 72 are defined primarily between the first and second flowpath surfaces 104*a* and 106*a* instead of by the struts 108*a*.

More specifically, first and second flowpath surfaces 104*a* and 106*a* include corresponding converging portions 122 extending from the strut leading edges 112 to the intermediate sections 114*a* to define the converging nozzle 74. The surfaces 104*a* and 106*a* also include diverging portions 124 extending from the strut intermediate sections 114*a* to the trailing edges 116 to define the diverging nozzle 78.

In this particular embodiment of the invention, the second flowpath surface 106*a* has a straight transverse section and is parallel to the CD axis 110, whereas the first flowpath converging and diverging portions 122 and 124 are inclined relative to the CD axis 110. In particular, the converging portion 122 is inclined at an angle $I_1$ of about 24°, and the diverging portion 124 is inclined at an angle $I_2$ of about 24°. Accordingly, the first flowpath converging and diverging portions 122 and 124 are the primary members which provide for decreasing and increasing areas in the converging nozzle 74 and the diverging nozzle 78, respectively. As illustrated in FIG. 8, the struts 108*a* are relatively straight and relatively flat and provide relatively little area change between adjacent struts 108. In this exemplary embodiment, there are 22 struts 108*a* disposed circumferentially about the longitudinal centerline 12 which are used primarily as structural members. As shown in FIG. 8 the maximum thickness intermediate section 114 of the struts 108*a* is not necessarily disposed at the intermediate section 114*a* which defines the throat 84 of the CD nozzle 72. In the embodiment illustrated, the strut intermediate section 114 is disposed upstream of the strut intermediate section 114*a*.

Although the second flowpath surface 106*a* in the embodiment illustrated in FIG. 7 is straight, it too, in an alternate embodiment, could have converging and diverging portions 122 and 124 which are inclined and disposed in a generally mirror image to those of the first flowpath surface 104*a*.

In alternate embodiments of the inventions, the first and second flowpath surfaces 104 and 106 and the struts 108 could have various profiles for obtaining the CD nozzle 72 illustrated schematically in FIG. 3.

In both the embodiments illustrated in FIGS. 6 and 8, the struts 108 are aligned generally parallel to the engine longitudinal centerline axis 12. In other embodiments of the invention, the struts 108 may be inclined relative to the engine centerline axis 12 in the circumferential direction for turning the extraction airflow 56 as desired, for example, for either swirling or deswirling the extraction airflow 56.

Illustrated in FIGS. 9–11 are three alternate arrangements of struts 108 which are crescent shaped and inclined relative to the engine longitudinal axis 112 for turning the extraction airflow 56 if desired. The FIG. 9 embodiment illustrates that the throat 84 may be formed between the leading edge 112 of one strut 108 and an intermediate section 126 of an adjacent strut 108 with the converging and diverging nozzle 74 and 78 disposed upstream and downstream therefrom, respectively.

FIG. 10 illustrates additionally that the throat 84 may be defined between corresponding intermediate sections 126 of adjacent struts 108 with the converging and diverging nozzles 74 and 78 being disposed upstream and downstream thereof, respectively.

FIG. 11 illustrates another embodiment wherein the throat 84 may be positioned between the trailing edge 116 of one strut 108 and the intermediate section 126 of an adjacent strut 108 with the converging and diverging nozzle 74 and 78 being disposed upstream and downstream thereof, respectively.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

More specifically, and for example, although an embodiment has been disclosed for extracting compressor airflow as first bypass airflow 56, the extraction airflow could be conventional bleed airflow for conventional purposes. In such a case, tubular, venturi-like conduits could be used for effecting the CD nozzle 72. Furthermore, although an axial compressor has been disclosed, the invention may be practiced in conjunction with a centrifugal compressor, or other structures having the required pressure ratios for obtaining choked and supersonic airflow.

I claim:

1. A method of extracting a portion of compressed air as extraction airflow from a continuously open port in a compressor disposed downstream of a plurality of circumferentially spaced blades extending from a compressor shaft rotatable in a speed range including a maximum speed comprising the steps of:

accelerating said extraction airflow received from said port through an extraction channel coupled between said port and a bypass duct to Mach 1 for obtaining choked airflow;

decelerating said choked airflow to a speed less than Mach 1 for obtaining subsonic airflow; and discharging said subsonic airflow as discharged airflow into said bypass duct, whereby said choked airflow in the extraction channel regulates the airflow through said port and prevents extraction airflow from increasing substantially relative to compressor airflow as compressor speed decreases.

2. A method according to claim 1 further including accelerating said choked airflow to a speed greater than Mach 1 for obtaining supersonic airflow and then decelerating said supersonic airflow for generating said subsonic airflow.

3. A method according to claim 2 further including generating a pressure ratio up to about 1.5 as said extraction airflow is accelerated and decelerated, wherein said pressure ratio is defined by a total pressure of said extraction airflow at said port divided by a static pressure of said discharged airflow.

* * * * *